US005843128A

United States Patent [19]

Wexler

[11] Patent Number: 5,843,128

[45] Date of Patent: Dec. 1, 1998

[54] MOLDED, POLYMERIC PACIFIER WITH A PLURALITY OF NIPPLES

[76] Inventor: Toby Wexler, 303 Paddington Dr., Lafayette, La. 70508-7145

[21] Appl. No.: 999,197

[22] Filed: Dec. 29, 1997

[51] Int. Cl.[6] ..... A61J 17/00

[52] U.S. Cl. ..... 606/234

[58] Field of Search ..... 606/234, 235, 606/236; D24/194, 199, 195, 196, 197, 198; 215/11.1–11.6; 446/419, 437; 273/58

[56] References Cited

U.S. PATENT DOCUMENTS

| | | | |
|---|---|---|---|
| D. 279,218 | 6/1985 | Carpel | D24/46 |
| 1,268,470 | 6/1918 | Johnson | 606/235 |
| 3,601,129 | 8/1971 | Siedl | 606/236 |
| 3,825,014 | 7/1974 | Wroten | 606/236 |
| 4,195,638 | 4/1980 | Duckstein | 606/236 |
| 4,830,364 | 5/1989 | Wexler | 272/93 |
| 5,292,336 | 3/1994 | Spence, Jr. et al. | 606/236 |
| 5,297,981 | 3/1994 | Maxim et al. | 446/437 |
| 5,601,605 | 2/1997 | Crow et al. | 606/236 |

*Primary Examiner*—Michael Buiz
*Assistant Examiner*—Vikki Trinh
*Attorney, Agent, or Firm*—Robert N. Montgomery

[57] ABSTRACT

A one piece pliable molded polymer pacifier including a pair of hollow balls, having multiple nipples extending therefrom, connected by a hollow tubular column. The nipples located upon each ball are located 90 degrees apart in the same or opposite planes from that of the nipples located on the opposite ball.

5 Claims, 3 Drawing Sheets

MOLDED, POLYMERIC PACIFIER WITH A PLURALITY OF NIPPLES

BACKGROUND OF THE INVENTION

1. Field of the Invention

This invention relates generally to baby pacifiers and more particularly to a multiple nipple pacifier.

2. General Background

Pacifiers have been designed for infants as a substitute for bottle nipples for many years. Such apparatus take many shapes, but most utilize the basic, commonly used, mouth shield and nipple arrangement, however, some provide a handle portion which is generally integral with the pacifier, while some provide a ring handle as seen in U.S. Pat. No. 5,292,336. Although it is desirable for a pacifier to have a handle so that the child or an adult can hold the pacifier, care must be taken so that the handle does not become a danger to the child.

Plural nipple pacifiers have been designed such as that disclosed in U.S. Des. 279,218 which provides a variety of odd shaped nipples clustered around a central core and further having a pair of rings made of a dissimilar material which may be dislodged or removed. This pacifier is unattractive and cumbersome, offers no explanation of its construction material, which could be tough or hard, and provides no restraint with regard as to how much of the nipple can be placed in the child's mouth, thereby possibly causing suffocation. Further, this configuration could cause harm to a child's eye due to the angle of the protrusions and there is no way for the child to grasp and position the pacifier.

Due to the child's lack of coordination, it is often difficult for the child to manipulate the pacifier by the handle portion, where one exists, and thereby place the nipple portion in its mouth. The mouth shields of most safe pacifiers are generally made of hard plastic, rubber or urethane and are therefore potentially hazardous should the child fall. However, such shields are considered necessary to prevent suffocation. The hard plastic shields are certainly uncomfortable if the child should fall asleep on the pacifier. Therefore, there is a need for a pliable, one piece pacifier having multiple nipples and a handle which may be grasped easily, thereby presenting an array of nipples to the child's mouth without manipulation. The size of most pacifiers makes them hard to locate and, therefore, they tend to get lost easily. Ideally a pacifier should be bright, large enough not be lost easily, yet lightweight.

SUMMARY OF THE INVENTION

The instant invention addresses the problems associated with pacifiers as discussed above in a unique manner. By providing a pair of soft, hollow, pliable balls located at each end of a hollow tubular column, with each ball having a plurality of conventional bottle nipples, each located in a manner which allows the child to suck on the nipples without interference from the adjacent nipple, the child can easily find and grasp the pacifier and insert one of the nipples in his mouth without manipulating the pacifier. The pacifier is large enough that it cannot be easily lost, and is brightly colored and is soft and pliable. The pacifier is made as a single blow molded unit, thereby eliminating any sharp edges.

BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

DETAILED DESCRIPTION OF THE PREFERRED EMBODIMENT

Figure 1:
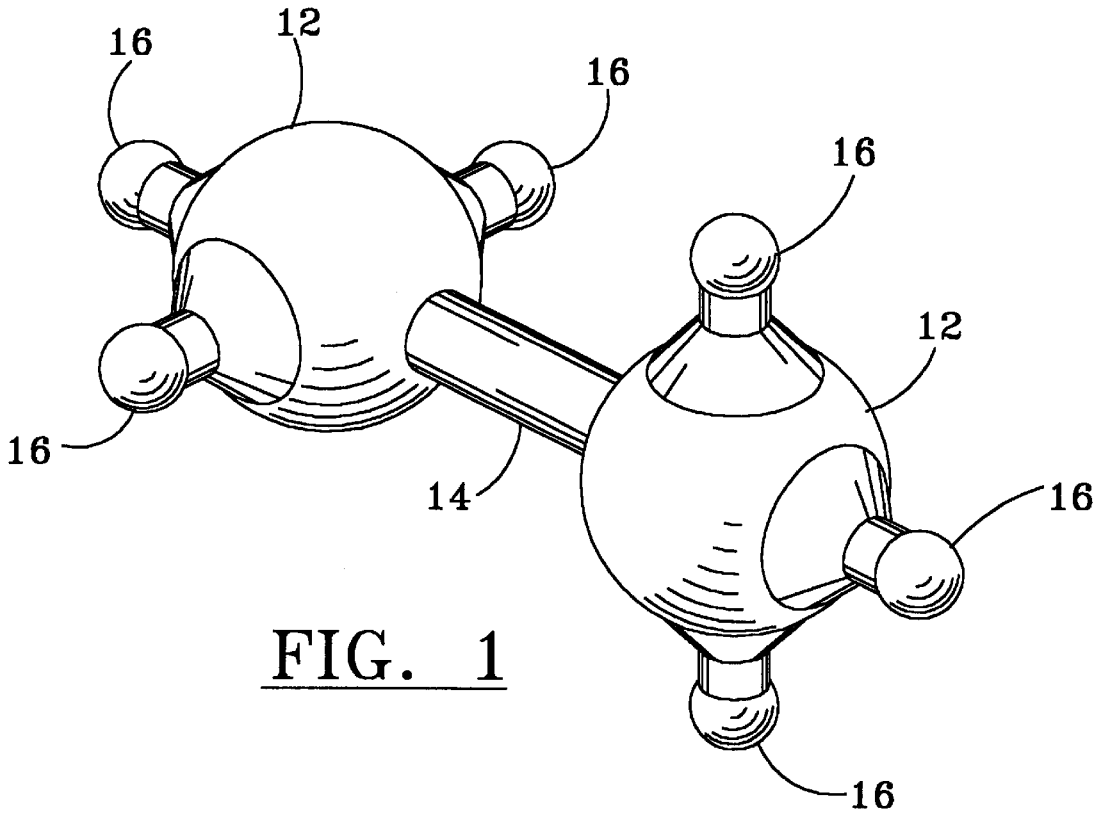
FIG. 1 is an isometric view of the pacifier.
Figure 2:
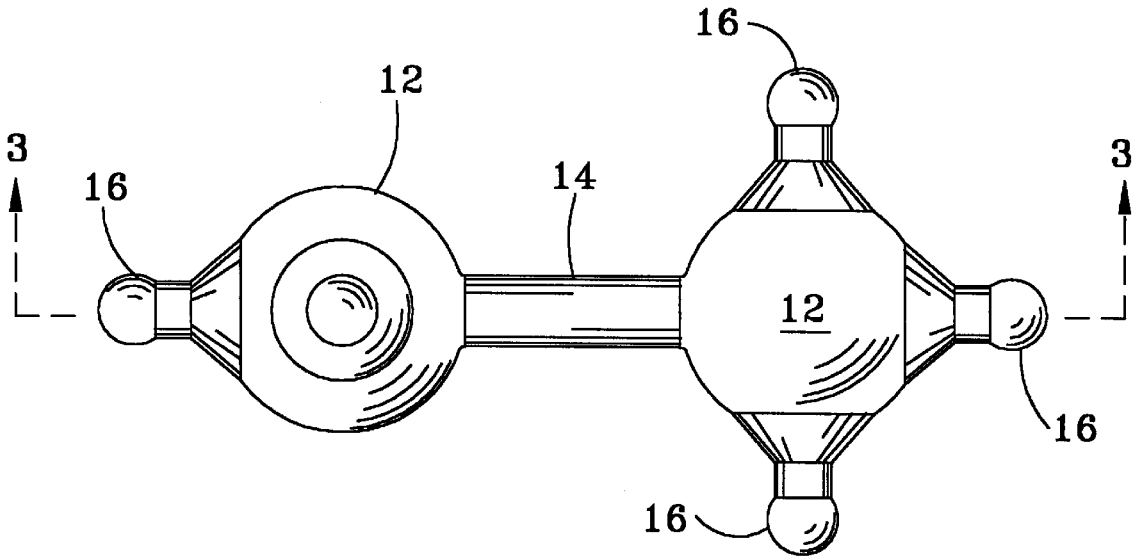
FIG. 2 is a front elevation view.
Figure 3:
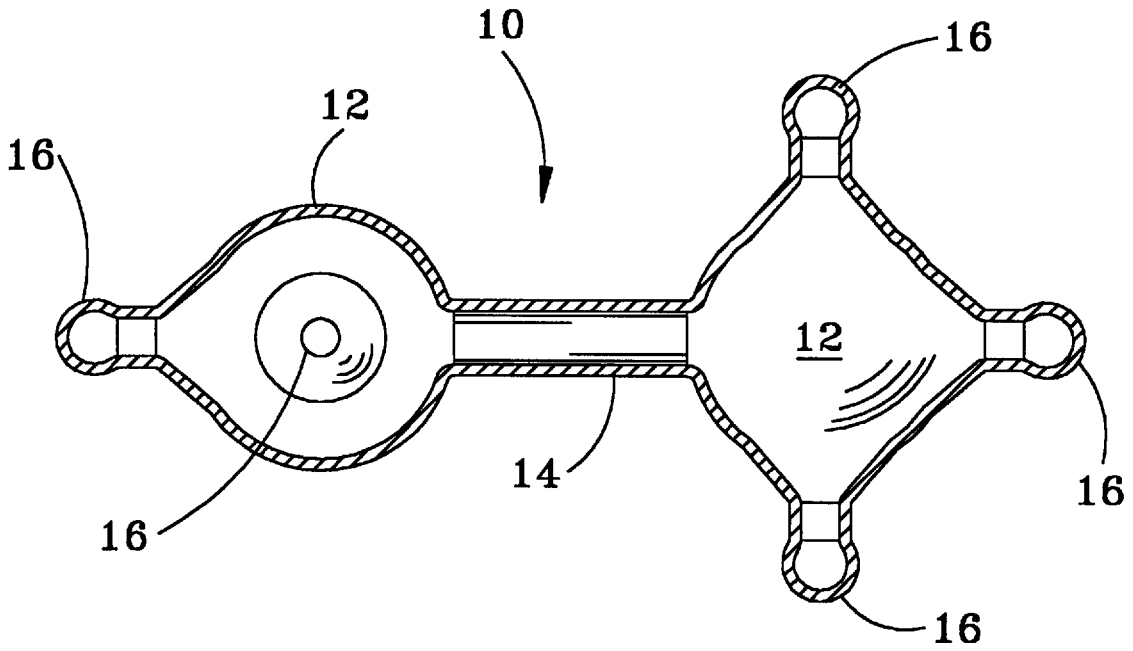
FIG. 3 is a cross section view taken along sight line 3—3 in FIG. 2.
Figure 4:
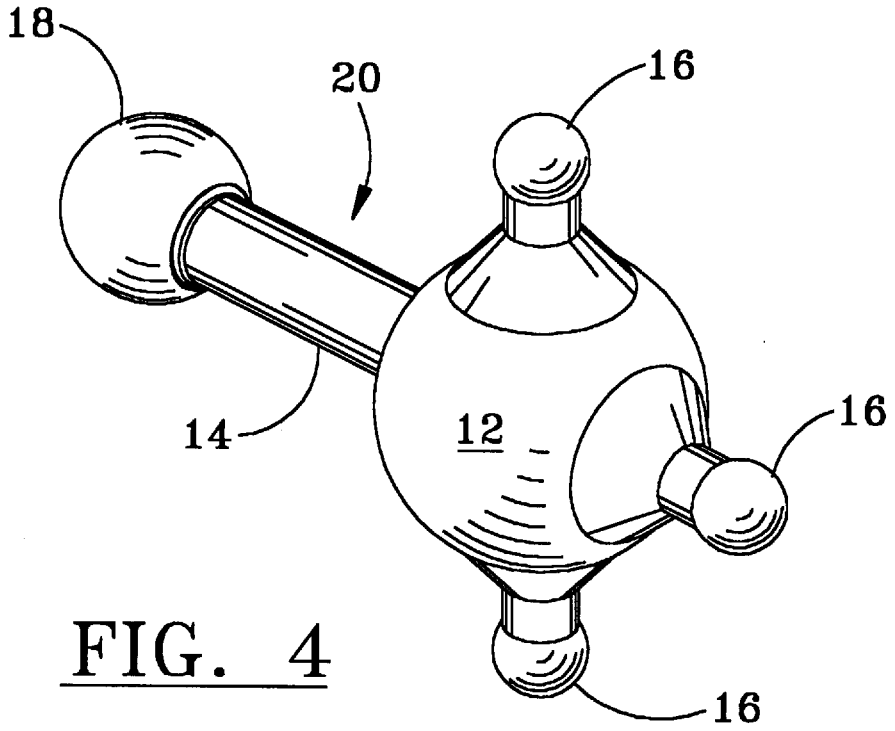
FIG. 4 is an isometric view of a second embodiment of the pacifier with nipples on only one end.
Figure 5:
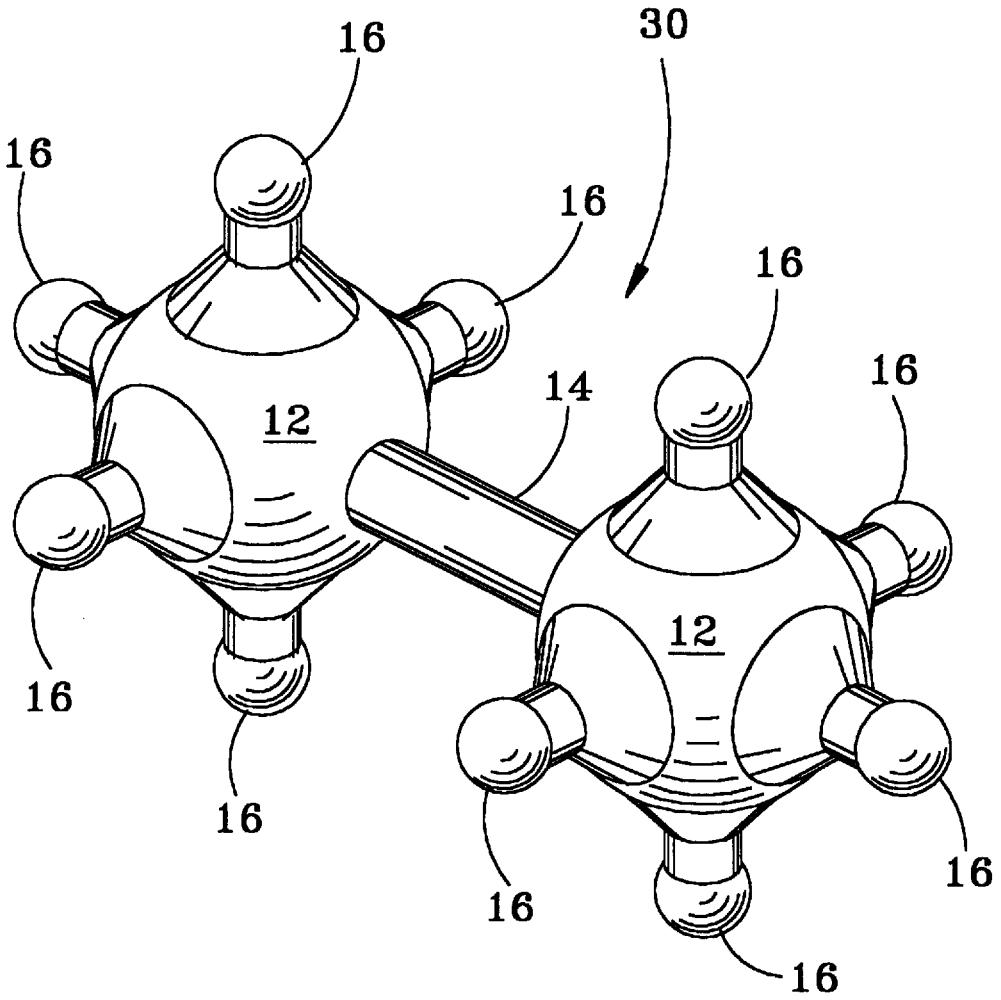
FIG. 5 is an isometric view of a third embodiment showing five nipples on each ball.

As seen in FIG. 1 the instant pacifier 10 includes a pair of balls attached by a tubular column 14 which serves as a means for grasping. Each ball 12 is configured with three baby bottle nipples 16 located at 90 degree increments in a horizontal plane on one ball and in the vertical plane on the opposite ball, better seen in FIG. 2. Each nipple 16 has a conventional baby bottle nipple configuration. As seen in the cross section view shown in FIG. 3, the pacifier is one piece construction having a relatively thin wall, blow molded using a sanitary, non-toxic polymer having a tear strength of approximately 230 psi, a tensile strength of approximately 1200 psi and an elongation of at least 500%. The pacifier has durometer in the range of 40–50 shore "A", thereby making the pacifier tough and very pliable with a soft texture. Depending on the molding process the wall thickness may vary from 0.062 to 0.187. It is anticipated that the material may be transparent or have colored pigment. The pacifier may be made from a non-toxic clear vinyl compound such as that utilized by the health and medical industries and manufactured to the highest standards of quality and purity and meet all industry standards for sanitation and traceability. It is anticipated that embodiment 20 having a single ball 12 with three nipple 16 and a handle portion 14 with a some what smaller ball 18 as shown FIG. 4 could be provided. This configuration may be advantageous for an older child with better dexterity. It is also anticipated that nipples 16 could be placed on the balls 12 in both the vertical and horizontal planes thereby producing five nipples on each ball as seen by the embodiment 30 in FIG. 5.

Because many varying and different embodiments may be made within the scope of the inventive concept herein taught, and because many modification may be made in the embodiments herein detailed in accordance with the descriptive requirement of the law, it is to be understood that the details herein are to be interpreted as illustrative and not in any limiting sense.

What is claimed is:

1. A one piece, molded polymeric pacifier comprising:

at least one hollow sphere;

a hollow tubular handle extended mesially and contiguously said sphere; and a plurality of hollow, pliable nipples extended contiguously and outwardly from at least one said hollow sphere.

2. The one piece, molded polymeric pacifier according to claim 1 wherein said nipples are located 90 degrees apart in at least one plane.

3. A one piece, molded polymeric pacifier comprising:

a) a pair of hollow spheres oriented opposite from one another;

b) a hollow tubular column extended mesially and contiguously said spheres; and c) a plurality of hollow, pliable nipples extended contiguously and outwardly from each of said polymeric balls.

4. The one piece, molded polymeric pacifier according to claim 3 wherein at least some of said nipples located upon one of said hollow spheres are orientated in a plane opposite that of at least some said plurality of nipples located upon the opposed sphere.

5. A process for constructing a pacifier comprising the step of molding hollow, one piece, pliable, polymeric pacifier having a plurality of nipples extending outwardly from a pair of adjacent balls connected by a means for grasping.

* * * * *